US010105945B1

(12) United States Patent
Izawa et al.

(10) Patent No.: US 10,105,945 B1
(45) Date of Patent: Oct. 23, 2018

(54) INKJET RECORDING APPARATUS AND RECORDING METHOD USING THE SAME

(71) Applicant: Miyakoshi Printing Machinery Co., Ltd., Narashino-shi, Chiba (JP)

(72) Inventors: Hideo Izawa, Narashino (JP); Takehiro Fujiwara, Yokote (JP)

(73) Assignee: MIYAKOSHI PRINTING MACHINERY CO., LTD., Narashino-shi, Chiba (JP)

( * ) Notice: Subject to any disclaimer, the term of this patent is extended or adjusted under 35 U.S.C. 154(b) by 0 days.

(21) Appl. No.: 15/673,711

(22) Filed: Aug. 10, 2017

(30) Foreign Application Priority Data

Apr. 24, 2017 (JP) ..... 2017-085738

(51) Int. Cl.

| | |
|---|---|
| ***B41J 2/085*** | (2006.01) |
| ***B41J 2/01*** | (2006.01) |
| *B41J 2/045* | (2006.01) |
| *B41J 2/165* | (2006.01) |

(52) U.S. Cl.
CPC ..... *B41J 2/01* (2013.01); *B41J 2/085* (2013.01); *B41J 2/04511* (2013.01); *B41J 2/04555* (2013.01); *B41J 2002/16561* (2013.01)

(58) Field of Classification Search
CPC . B41J 2/01; B41J 2/085; B41J 2/04511; B41J 2/04555; B41J 2002/16561
See application file for complete search history.

(56) References Cited

U.S. PATENT DOCUMENTS

| | | | | |
|---|---|---|---|---|
| 9,114,609 | B1 | 8/2015 | Folkins et al. | |
| 2007/0002115 | A1* | 1/2007 | Nakazawa | B41J 2/06 347/102 |
| 2011/0181658 | A1* | 7/2011 | Izawa | B41J 2/155 347/34 |
| 2014/0292905 | A1* | 10/2014 | Hagiwara | B41J 2/155 347/22 |
| 2015/0070456 | A1* | 3/2015 | Imoto | B41J 11/007 347/104 |

FOREIGN PATENT DOCUMENTS

| | | | |
|---|---|---|---|
| JP | 05-330034 | A | 12/1993 |
| JP | 11-245389 | A | 9/1999 |
| JP | 2015-058619 | A | 3/2015 |

OTHER PUBLICATIONS

European Search Report for corresponding application No. 17186347.5, dated Feb. 27, 2018 (7 pages).

* cited by examiner

*Primary Examiner* — Yaovi M Ameh
(74) *Attorney, Agent, or Firm* — Flynn Thiel, P.C.

(57) ABSTRACT

An inkjet recording apparatus 100 which records on a transferred recording medium X by an inkjet scheme, wherein the inkjet recording apparatus 100 includes guide rolls R for guiding the recording medium X, the recording medium X being negatively charged, recording units 1, 2, 3, and 4 formed of a plurality of recording heads 1*a*, 2*a*, 3*a*, and 4*a* for spraying ink onto the recording medium X, and a conductive frame unit 11 for supporting the recording heads 1*a*, 2*a*, 3*a*, and 4*a*, the recording heads 1*a*, 2*a*, 3*a*, and 4*a* and the conductive frame unit 11 having a continuity relation and the recording heads 1*a*, 2*a*, 3*a*, and 4*a* being grounded via the conductive frame unit 11.

15 Claims, 11 Drawing Sheets

INKJET RECORDING APPARATUS AND RECORDING METHOD USING THE SAME

TECHNICAL FIELD

The present invention relates to inkjet recording apparatuses and recording methods using the same and, in further detail, to an inkjet recording apparatus capable of preventing ink splashes and contamination of a recording head and recording with high accuracy and a recording method using the same.

BACKGROUND ART

Inkjet recording apparatuses are apparatuses which spray ink onto a transferred recording medium for recording.

Meanwhile, in an inkjet recording apparatus, when the recording medium is transferred, the recording medium may rub against a guide roll or part of the apparatus to move a charge from one side to the other to cause a potential difference, thereby possibly charging the recording medium with so-called triboelectricity (hereinafter also referred to as "static electricity").

Then, part of the ink drops sprayed from the recording head may be influenced by that static electricity, thereby possibly causing ink splashes and significantly degrading the accuracy of the inkjet recording.

By contrast, to remove the influences of static electricity in the inkjet recording apparatus, various techniques have been developed.

For example, an inkjet recording apparatus has been known in which a surface potential of a recording sheet on a charge absorption belt is measured by a surface potential measuring means and, in accordance with that measurement result, a control means controls an output voltage of a variable power supply for a brush-shaped electrode, thereby allowing a potential difference between a recording head and the recording sheet to be reduced (for example, refer to PTL 1).

Also, an inkjet recording apparatus has been known in which, in addition to a conductive pattern for causing an electrostatic absorption power, a conductive pattern kept at an approximately same potential as that of a recording head is provided inside a transfer belt, thereby preventing the generation of an electric field between a discharge port of the recording head and a paper sheet (for example, refer to PTL 2). In this inkjet recording apparatus, even if discharged droplets are separated into a main drop and satellites, polarization does not occur therebetween, and the satellites can be directed toward the paper sheet together with the main drop.

Also, a recording apparatus has been known including a setting unit which sets a recording-target medium, a head unit which discharges ink onto the recording-target medium, a transfer roller unit provided between the setting unit and the head unit in a transfer route of the recording-target medium to transfer the recording-target medium, an air blowing unit which blows air onto a recording surface side of the recording-target medium transferred by the transfer roller unit between the transfer roller unit and the head unit, and an ion generating unit provided between the air blowing unit and the recording surface side of the recording-target medium in an air blowing route by the air blowing unit (for example, refer to PTL 3). In this recording apparatus, ions generated by the ion generating unit are delivered to the recording-target medium, thereby allowing a peeling charge by the transfer roller unit which transfers the recording-target medium to be inhibited.

CITATION LIST

Patent Literature

PTL 1: Japanese Patent Application Laid-Open No. 05-330034

PTL 2: Japanese Patent Application Laid-Open No. 11-245389

PTL 3: Japanese Patent Application Laid-Open No. 2015-58619

SUMMARY OF INVENTION

Technical Problem

However, in the inkjet recording apparatus described in the above PTL 1, it is impossible to eliminate an electric field generated between the recording head and the recording medium, and thus it is impossible to say that ink splashes can be sufficiently prevented.

In the inkjet recording apparatus described in the above PTL 2, by inhibiting the generation of an electric field, the satellites are directed toward the paper sheet. On the other hand, due to an oppositely-oriented electric field generated on both sides of the discharge port of the recording head, a floating ink mist may be attached to a nozzle surface of the recording head and its surroundings to possibly contaminate the recording head. In this case, this contamination causes a defective discharge of the recording head.

In the recording apparatus described in the above PTL 3, an airflow is blown from the air blowing unit to a lower part of the head unit. Thus, a disorder of a flying trajectory of ink discharged from the head unit may occur to cause an image disorder.

The present invention was made in view of the above circumstances, and has an object of providing an inkjet recording apparatus capable of preventing ink splashes and contamination of a recording head and recording with high accuracy.

Solution to Problems

After diligent studies to solve the above problems, the inventors have found that the above problems can be solved by actively charging the recording medium with a negative charge and, on the other hand, by grounding the recording head via a conductive frame unit, thereby achieving completion of the present invention.

The present invention resides in (1) an inkjet recording apparatus which records on a transferred recording medium by an inkjet scheme, the apparatus including: a guide roll for guiding the recording medium; the recording medium being negatively charged; a recording unit formed of a plurality of recording heads for spraying ink onto the recording medium; and a conductive frame unit for supporting the recording heads, the recording head and the conductive frame unit having a continuity relation, and the recording heads being grounded via the conductive frame unit.

The present invention resides in (2) the inkjet recording apparatus according to the above (1), further including a substrate coupled to the recording heads via connectors for controlling the driving of the recording heads, wherein the conductive frame unit is coupled to the substrate via a main conductive wire, and the recording heads are grounded via the conductive frame unit, the main conductive wire, and the substrate.

The present invention resides in (3) the inkjet recording apparatus according to the above (2), wherein the recording heads are directly coupled to the substrate via a sub conductive wire.

The present invention resides in (4) the inkjet recording apparatus according to the above (1), further including an upstream-side ion generator for providing the recording medium with a charge, wherein the upstream-side ion generator is positioned on an upstream side of the recording unit on a transfer route of the recording medium.

The present invention resides in (5) the inkjet recording apparatus according to the above (4), the upstream-side ion generator is arranged on a recording surface side of the recording medium, and is to provide the recording medium with a negative charge.

The present invention resides in (6) the inkjet recording apparatus according to the above (4), wherein a plurality of the recording units are provided along the transfer route of the recording medium, and the apparatus further comprises, on a back surface side of the recording medium between the recording units, an intermediate ion generator for providing the recording medium with a negative charge.

The present invention resides in (7) the inkjet recording apparatus according to the above (4), further including, on a back surface side of the recording medium, an electrostatic sensor for measuring a charge voltage of the recording medium.

The present invention resides in (8) the inkjet recording apparatus according to the above (7), wherein the guide roll is arranged between the upstream-side ion generator and the recording unit in the transfer route of the recording medium, and the electrostatic sensor is arranged on a downstream side of the guide roll.

The present invention resides in (9) the inkjet recording apparatus according to the above (7), wherein the electrostatic sensors are arranged at positions opposing the recording unit.

The present invention resides in (10) the inkjet recording apparatus according to any one of the above (7) to (9), wherein a plurality of the electrostatic sensors are arranged in a width direction of the recording medium.

The present invention resides in (11) a recording method using the inkjet recording apparatus according to the above (7), the method including a charging step of providing, by the upstream-side ion generator, the recording medium with a negative charge, a recording step of spraying, by the recording unit, ink onto the recording medium provided with the negative charge, a measuring step of measuring, by the electrostatic sensor, a charge voltage of the recording medium, and an adjusting step of adjusting a charge amount to be provided by the upstream-side ion generator based on the charge voltage, wherein the charging step, the recording step, the measuring step, and the adjusting step are repeatedly performed.

Advantageous Effects of Invention

In the inkjet recording apparatus of the present invention, the recording head is set to have a continuity relation with the conductive frame unit, and the recording head is grounded via the conductive frame unit, thereby allowing the charge voltage of ink circulated in the recording head to be set also at 0 V.

And, in the inkjet recording apparatus, as a recording medium, one negatively charged is actively adopted, thereby allowing a potential difference to occur between the recording head and the recording medium.

From these, in the inkjet recording apparatus, an electrostatic force occurs between the recording head and the recording medium, and an electric field can be generated from the recording head with a high potential to the recording medium with a low potential.

As a result, in the inkjet recording apparatus, ink with a charge voltage of 0 V is sprayed onto the negatively-charged recording medium, thereby causing ink to be attracted to the recording medium. Thus, ink splashes can be prevented.

Also, without a disorder of a flying trajectory of ink sprayed from the recording head, recording with a high accuracy can be performed.

Furthermore, similarly on both sides of the recording head, a floating ink mist and so forth are attracted to the recording medium, thereby allowing prevention of contamination of the recording head.

In the inkjet recording apparatus of the present invention, the recording head is grounded via the conductive frame unit, the main conductive wire, and the substrate, thereby setting charge voltages of also the substrate in addition to the recording head and the conductive frame unit at 0 V. This can simultaneously inhibit an electric shock of the substrate, in addition to the above-described effects.

Also, with the conductive frame unit being grounded via the substrate rather than being directly ground, wiring can be simplified, and breakage of the substrate due to static electricity, electric overvoltage (thunder), or the like can be prevented.

In the inkjet recording apparatus of the present invention, with the recording head directly coupled to the grounded substrate via the sub conductive wire, grounding is made via two routes, thereby allowing the charge voltage to be more reliably set at 0 V.

In the inkjet recording apparatus of the present invention, the upstream-side ion generator is provided on the upstream side of the recording unit, thereby allowing the charge of the recording medium to be adjusted so that the recording medium is appropriately negatively charged before the recording head sprays ink.

Specifically, when the upstream-side ion generator is arranged on the recording surface side of the recording medium and is to provide the recording medium with a negative charge, a negative charge can be provided before the recording head sprays ink even if the recording medium for use is not negatively charged.

Therefore, in this case, even if a recording medium with a different charge voltage or charge polarity is used, the recording medium can be made as being appropriately negatively charged accordingly.

In the inkjet recording apparatus of the present invention, when the intermediate ion generator for providing the recording medium with a negative charge is further provided on the back surface side of the recording medium between the recording units, even if a change occurs in the charge of the recording medium being transferred due to the spraying of ink onto the recording medium by the recording head or rubbing of the recording medium against the guide roll or part of the apparatus, with the intermediate ion generator providing a negative charge, the recording medium can be again negatively-charged appropriately.

In the inkjet recording apparatus of the present invention, the electrostatic sensor for measuring a charge voltage of the recording medium is further provided on the back surface side of the recording medium, thereby allowing the monitoring of the state of the charge assumed by the transferred recording medium.

Also, when the guide roll is arranged between the upstream-side ion generator and the recording unit in the transfer route of the recording medium, by arranging the electrostatic sensor on a downstream side of the guide roll, it is possible to monitor an influence on the charge of the recording medium (such as a charge change) due to the rubbing of the recording medium against the guide roll.

Furthermore the electrostatic sensor is more preferably arranged at a position opposing the recording unit. In this case, it is possible to monitor the state of the charge of the recording medium immediately before or immediately after the recording head sprays ink.

Note in the inkjet recording apparatus that a plurality of electrostatic sensors are arranged in the width direction of the recording medium, thereby allowing the state of the charge to be monitored over the entire recording medium.

In the recording method of the present invention, with the provision of the charging step and the recording step, ink is attracted to the recording medium, thereby allowing the prevention of ink splashes and contamination of the recording head and also recording with high accuracy.

Also, the measuring step and the adjusting step are further provided, and the charging step, the recording step, the measuring step, and the adjusting step are repeatedly performed, thereby allowing stable recording to be continued, with changes in the charge of the recording medium being supported.

BRIEF DESCRIPTION OF DRAWINGS

FIG. 2(*b*) is a partial sectional view obtained by cutting along an A-A line of FIG. 2(*a*).

DESCRIPTION OF EMBODIMENTS

Figure 1:
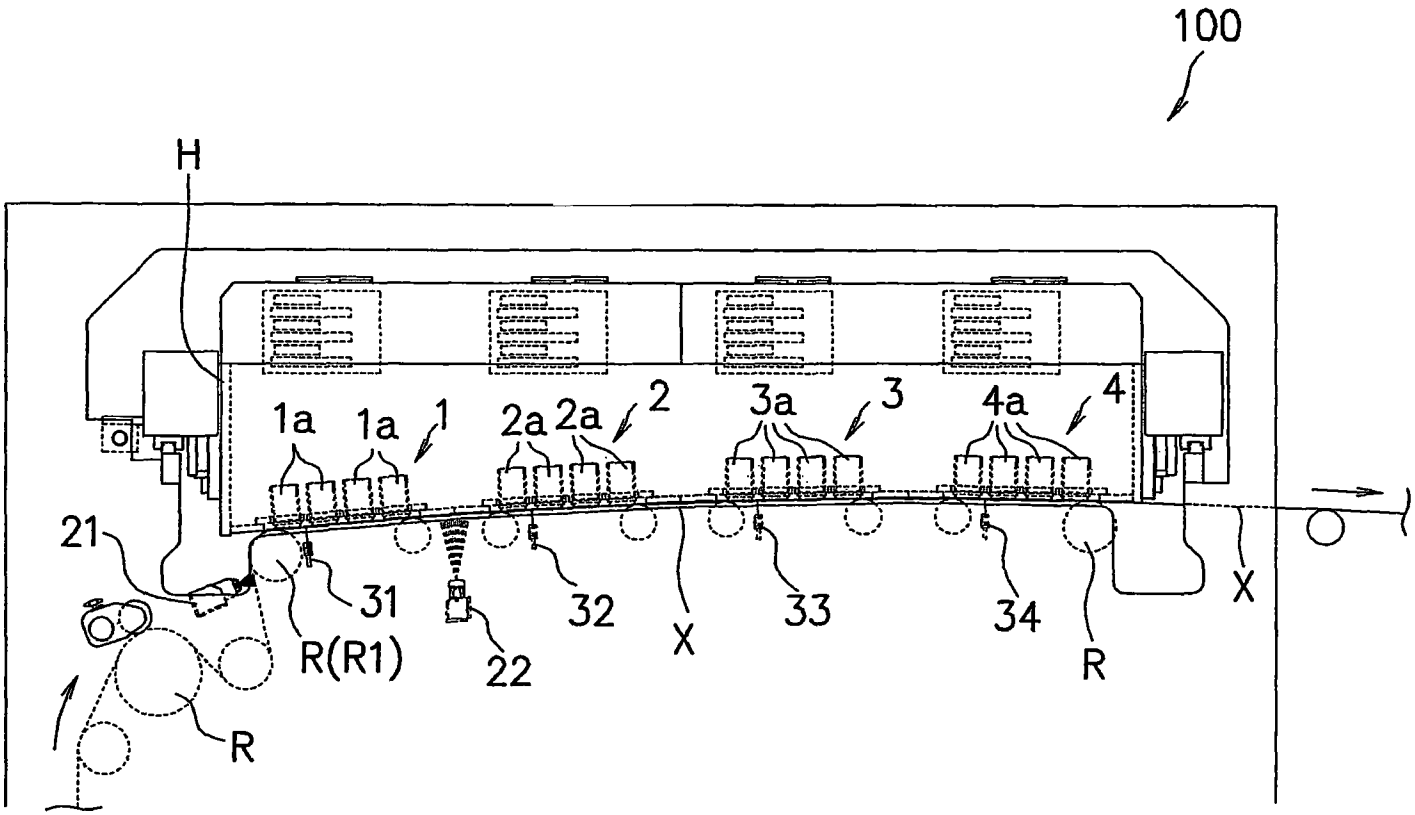
FIG. 1 is a schematic side view depicting one embodiment of an inkjet recording apparatus according to the present invention.

In the following, with reference to the drawings as required, suitable embodiments of the present invention are described in detail. Note that the same components in the drawings are provided with a same reference character and redundant descriptions are omitted. Also, positional relations such as above, below, left and right are assumed to be based on positional relations depicted in the drawings unless otherwise specified. Furthermore, dimensional ratios in the drawings are not limited to the ratios depicted in the drawings.

An inkjet recording apparatus according to the present invention is an apparatus for recording by spraying ink from a recording head onto a transferred recording medium.

In the above inkjet recording apparatus, the ink is not particularly restrictive, and any commercially-available one can be adopted as appropriate. Specifically, examples can include a water-based dye, a water-based pigment, an oil-based dye, an oil-based pigment, and so forth.

Also, the recording medium is not particularly restrictive, and any commercially-available one can be adopted as appropriate. Specifically, examples can include paper, cloth, film, and so forth.

FIG. 1 is a schematic side view depicting one embodiment of the inkjet recording apparatus according to the present invention.

As depicted in FIG. 1, an inkjet recording apparatus 100 according to the present embodiment includes: a plurality of guide rolls R for guiding a recording medium X; the recording medium X being negatively charged; recording units 1, 2, 3, and 4 formed of a plurality of recording heads for spraying ink onto the recording medium X; a housing H which accommodates the recording units 1, 2, 3, and 4; a conductive frame unit, not depicted, for supporting the recording heads; a substrate, not depicted, coupled to the recording heads via connectors for controlling the driving of the recording heads; an upstream-side ion generator 21 for providing the recording medium X with a negative charge; an intermediate ion generator 22 on a back surface side of the recording medium X among the recording units 1, 2, 3, and 4 for providing the recording medium X with a negative charge; and a plurality of electrostatic sensors 31, 32, 33, and 34 on the back surface side of the recording medium X for measuring the charge voltages of the recording medium X.

In the inkjet recording apparatus 100, a plurality of guide rolls R are provided. By the guide rolls R, the continuous long recording medium X is guided so as to pass through a predetermined transfer route.

Incidentally, the guide rolls R are arranged so as to provide a certain tension so that the recording medium X does not slacken, thereby making a situation in which they rub against the transferred recording medium X. Thus, the recording medium X generally tends to be charged with static electricity.

In the inkjet recording apparatus 100, the recording units 1, 2, 3, and 4 are provided at four locations along the transfer route of the recording medium X, and also are accommodated in the housing H.

Ink is sprayed by the recording units 1, 2, 3, and 4 onto the recording medium X.

Note in the present specification that, for convenience, the recording unit 1 on an uppermost stream side of the transfer route of the recording medium X is referred to as a "first recording unit 1", the recording unit 2 on its downstream side is referred to as a "second recording unit 2", the recording unit 3 on its downstream side is referred to as a "third recording unit 3", and the recording unit 4 on a lowermost stream side is referred to as a "fourth recording unit 4".

Figure 2A:
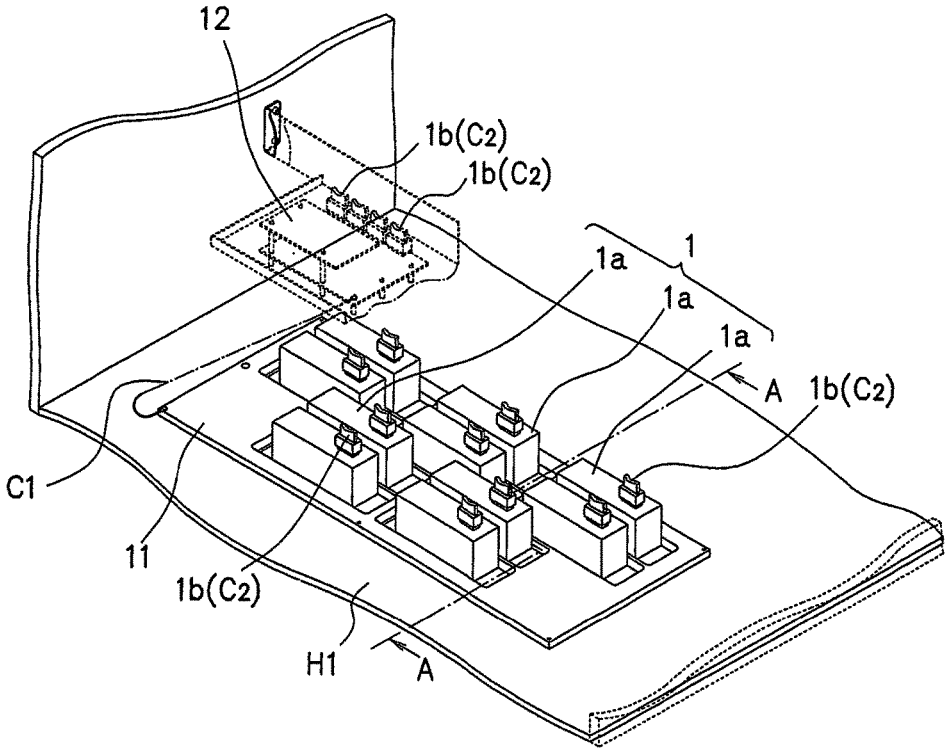
FIG. 2(*a*) is a partially transparent perspective view schematically depicting a first recording unit of the inkjet recording apparatus according to the present embodiment.
Figure 2B:
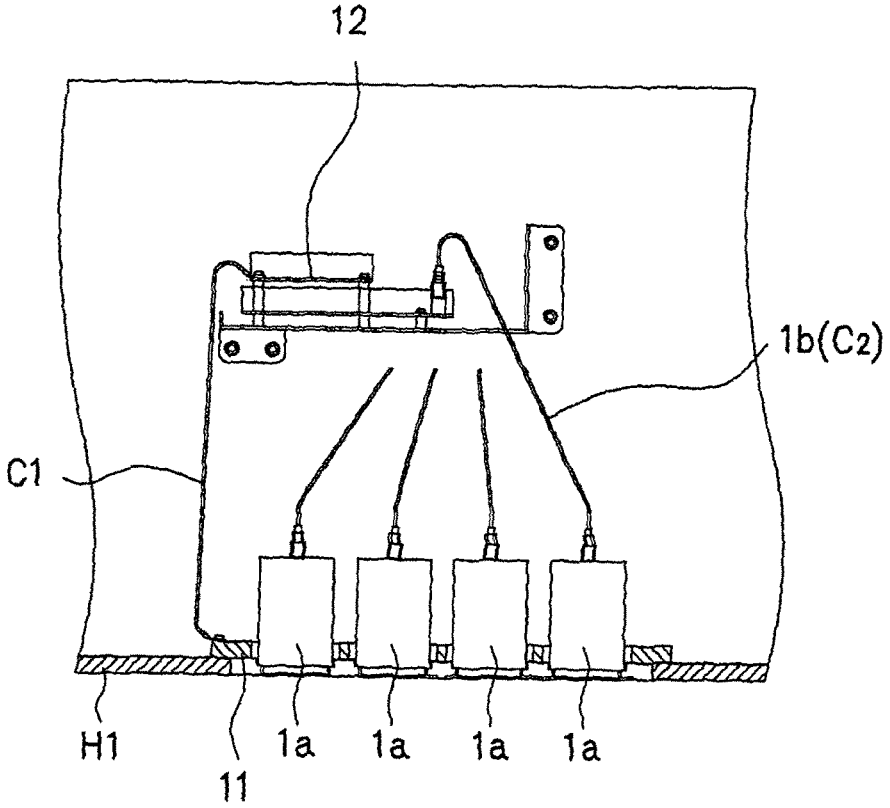

FIG. 2(*a*) is a partially transparent perspective view schematically depicting the first recording unit of the inkjet recording apparatus according to the present embodiment, and FIG. 2(*b*) is a partial sectional view obtained by cutting along an A-A line of FIG. 2(*a*). Note that the second recording unit 2, the third recording unit 3, and the fourth recording unit 4 have the same structure as that of the first recording unit 1 except that the ink for use may be different and description is thus omitted.

As depicted in FIG. 2(*a*), the first recording unit 1 is formed of a plurality of recording heads 1*a* for spraying ink onto the recording medium X.

Each recording head 1*a* is a so-called fixed-type line head, and is provided, on its lower surface, with a nozzle unit where a plurality of nozzles are formed along a width direction of the recording head 1*a* (a width direction of the recording medium).

In the inkjet recording apparatus 100, the recording medium X is transferred in a direction perpendicular to the width direction of the recording head 1*a* and, by spraying ink from the nozzle unit of the recording head 1*a* downward, ink is sprayed onto the recording medium X.

Here, each recording head 1*a* is formed of a conductive material in its entirety. Thus, ink to be circulated through a channel in the recording head 1*a* and sprayed from the nozzle part has substantially the same electric potential as that of the recording head 1*a*.

Each recording head 1*a* is supported by a plate-shaped conductive frame unit 11. Specifically, each recording head 1*a* is attached so as not to prevent the downward spraying of ink by the recording head 1*a* and so as to cover each of a plurality of head holes provided in the conductive frame unit 11.

The conductive frame unit 11 is attached and fixed to a lower plate H1 so as not to prevent the downward spraying of ink by each recording head 1*a* and so as to cover each frame hole provided in the lower plate H1 of the housing H.

Here, the conductive frame unit 11 is formed of a conductive material in its entirety and the recording heads 1*a* and the conductive frame unit 11 have a continuity relation. Thus, the conductive frame unit 11, the recording heads 1*a*, and the ink to be sprayed from the recording heads 1*a* have substantially the same electric potential.

Note that in the conductive frame unit 11, the frame unit 11 may be surface-treated if the continuity relation between the recording heads 1*a* and a main conductive wire C1, which will be described further below, can be maintained.

As depicted in FIG. 2(*a*) and FIG. 2(*b*), in the inkjet recording apparatus 100, one end of the main conductive wire C1 is attached to an end part of the conductive frame unit 11 via a conductive pin or the like, and the other end of the main conductive wire C1 is coupled to a grounded substrate 12.

This causes the substrate 12, the main conductive wire C1, the conductive frame unit 11, each recording head 1*a*, and the ink to be sprayed from each recording head 1*a* to have substantially the same electric potential.

Each recording head 1*a* is coupled to the substrate 12 via a connector 1*b*.

As with conventional inkjet recording apparatuses, the substrate 12 is to control the driving of each recording head 1*a* via a communication wiring formed in the connector 1*b*.

The substrate 12 is grounded to prevent an electric shock.

In the inkjet recording apparatus 100, the substrate 12 is grounded as described above, and thus the recording heads 1*a* are in a state of being grounded via the conductive frame unit 11, the main conductive wire C1, and the substrate 12. This allows the charge voltages of the recording heads 1*a*, the conductive frame unit 11, and the substrate 12 to be simultaneously set at 0 V and, furthermore, the charge voltage of the ink to be circulated in the recording heads 1*a* and sprayed from the nozzle part to be also set at 0 V.

In this manner, in the inkjet recording apparatus 100, with the conductive frame unit 11 being grounded via the substrate as described above rather than being directly grounded, the wiring can be simplified, and breakage of the substrate due to static electricity, electric overvoltage (thunder), or the like can be prevented.

Also in the inkjet recording apparatus 100, separately from the above-described main conductive wire C1, the recording head 1*a* is directly coupled to the substrate 12 via a sub conductive wire C2.

This sub conductive wire C2 is incorporated in the connector 1*b* so as not to be powered by the communication wire for controlling the driving of the recording head 1*a* formed in the connector 1*b*.

The sub conductive wire C2 has one end coupled to the recording head 1*a* and the other end coupled to the grounded substrate 12. That is, the recording head 1*a* is coupled to the grounded substrate 12 via the sub conductive wire C2 incorporated in the connector 1*b*.

In this manner, in the inkjet recording apparatus 100, with the recording head 1*a* coupled to the grounded substrate 12 via the main conductive wire C1 and the sub conductive wire C2, grounding is made via two routes, thereby allowing the charge voltage of the recording head 1*a* to be more reliably set at 0 V.

Referring back to FIG. 1, in the inkjet recording apparatus 100, the ion generator 21 (hereinafter also referred to as an "upstream-side ion generator 21") is provided on a recording surface side of the recording medium X on an upstream side of the recording units 1, 2, 3, and 4 in the transfer route of the recording medium X.

This upstream-side ion generator 21 has an ion generating unit where a plurality of nozzles are formed along the width direction of the recording medium X and a sensor for monitoring a charge amount outputted from the ion generating unit. Note that as the upstream-side ion generator 21, any commercially-available one can be adopted as appropriate and a detailed description is thus omitted.

In the inkjet recording apparatus 100, with the upstream-side ion generator 21 providing the recording medium X with a negative charge, the recording medium X can be negatively charged.

In the inkjet recording apparatus 100, a charge is provided from the upstream-side ion generator 21 so that the recording medium X is negatively charged. That is, when the recording medium X is not charged or is positively charged, the upstream-side ion generator 21 provides a negative charge.

In this manner, in the inkjet recording apparatus 100, the upstream-side ion generator 21 which provides the recording medium X with a negative charge is provided on an upstream side of the recording units 1, 2, 3, and 4, and the charge of the recording medium X can thus be adjusted before the recording heads spray ink so that the recording medium X is negatively charged appropriately.

In the inkjet recording apparatus 100, the ion generator 22 (hereinafter also referred to as an "intermediate ion generator 22") is provided on the back surface side of the recording medium X between the first recording unit 1 and the second recording unit 2.

This intermediate ion generator 22 has an ion generating unit 22*a* (refer to FIG. 3) where a plurality of nozzles are formed and a sensor for monitoring a charge amount outputted from the ion generating unit 22*a*. Note that as the intermediate ion generator 22, any commercially-available one can be adopted as appropriate and a detailed description is thus omitted. Also, the intermediate ion generator may be one identical to or different from the upstream-side ion generator 21.

In the inkjet recording apparatus 100, with the intermediate ion generator 22 providing the recording medium X with a negative charge from the ion generating unit 22*a*, the recording medium X can be negatively charged.

Here, when the recording medium X is paper and its paper thickness is 135 kg/duodecimo or smaller, electrostatic charges on the front surface (recording surface) and the back surface have the same polarity and the same potential. Note that the duodecimo is a standard of paper dimensions and means a size of 788 mm×1091 mm.

Therefore, in this case, with the intermediate ion generator 22 providing a negative charge on the back surface side of paper, the recording surface side of the paper also has a negative charge.

Note that the charge voltage on the paper back surface side can be set as a charge voltage on the paper surface side at the same position. Thus, at a location on the paper surface side where the charge voltage measurement is difficult, such as straight below a recording head, it is enough to measure the charge voltage on the paper back surface side at that position. In this case, the electrostatic sensor is not installed between the recording heads but is enough to be installed on the paper back surface side opposing the recording head, thereby allowing space saving of the recording unit itself.

In this manner, in the inkjet recording apparatus 100, the intermediate ion generator 22 which provides the recording medium X with a negative charge is provided between the first recording unit 1 and the second recording unit 2. Thus, even if a change occurs in the charge of the recording medium X being transferred due to the spraying of ink onto the recording medium X by the recording head 1*a* of the first recording unit 1 or rubbing of the recording medium X against the guide rolls R or part of the apparatus, with the intermediate ion generator 22 providing a negative charge, the recording medium X can be again negatively-charged appropriately.

In the inkjet recording apparatus 100, a guide roll (hereinafter a "immediately-preceding guide roll R1) which guides the recording medium X to a recording unit 1 side is provided, and the immediately-preceding guide roll R1 is arranged on the transfer route of the recording medium X between the above-described upstream-side ion generator 21 and the recording unit 1.

On a downstream side of the immediately-preceding guide roll R1, a plurality of electrostatic sensors 31, 32, 33, and 34 are arranged for measuring the charge voltages of the recording medium X.

In the inkjet recording apparatus 100, the recording medium X provided with a negative charge by the upstream-side ion generator 21 rubs against the immediately-preceding guide roll R1 to possibly cause a change in the charge of the recording medium X, and thus the state of the charge assumed by the transferred recording medium X is monitored by the electrostatic sensors 31, 32, 33, and 34 on the downstream side of the immediately-preceding guide roll R1.

Figure 3:
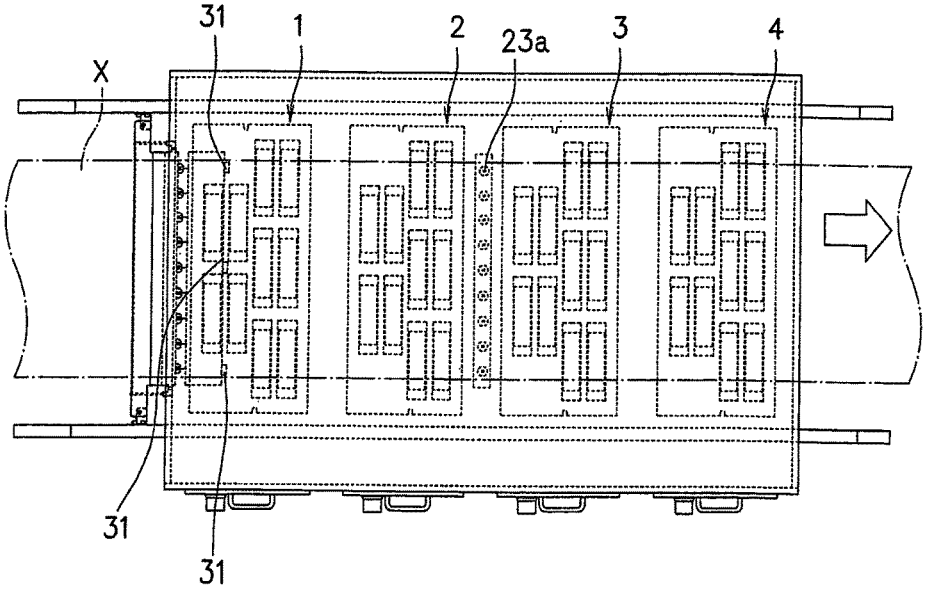
FIG. 3 is a descriptive diagram for describing the positions of electrostatic sensors with respect to the recording units of the inkjet recording apparatus according to the present embodiment, the diagram viewed from below the recording units.

FIG. 3 is a descriptive diagram for describing the positions of the electrostatic sensors with respect to the recording units of the inkjet recording apparatus according to the present embodiment, the diagram being viewed from below the recording units.

Note in the present specification that, for convenience, the electrostatic sensor 31 on an uppermost stream side of the transfer route of the recording medium X is referred to as a "first electrostatic sensor 31", the electrostatic sensor 32 on its downstream side is referred to as a "second electrostatic sensor 32", the electrostatic sensor 33 on its downstream side is referred to as a "third electrostatic sensor 33", and the electrostatic sensor 34 on a lowermost stream side is referred to as a "fourth electrostatic sensor 34".

As depicted in FIG. 3, in the inkjet recording apparatus 100, the first electrostatic sensors 31 are arranged at positions opposing the first recording unit 1 on the back surface side of the recording medium X, specifically, between the recording head 1*a* on the first row and the recording head 1*a* on the second row; the second electrostatic sensors 32 are arranged at positions opposing the second recording unit 2 on the back surface side of the recording medium X, specifically, between the recording head 2*a* on the first row and the recording head 2*a* on the second row; the third electrostatic sensors 33 are arranged at positions opposing the third recording unit 3 on the back surface side of the recording medium X, specifically, between the recording head 3*a* on the first row and the recording head 3*a* on the second row; and the fourth electrostatic sensors 34 are arranged at positions opposing the fourth recording unit 4 on the back surface side of the recording medium X, specifically, between the recording head 4*a* on the first row and the recording head 4*a* on the second row.

This allows monitoring of the state of the charge of the recording medium X immediately before or immediately after each of the recording units 1, 2, 3, and 4 spray ink.

Also, in the inkjet recording apparatus 100, the first electrostatic sensors 31 are arranged at three locations at the center and both sides along the width direction of the recording medium X. Note that the second electrostatic sensors 32, the third electrostatic sensors 33, and the fourth electrostatic sensors 34 are similarly arranged respectively at three locations at the center and both sides along the width direction of the recording medium X.

This allows monitoring of the state of the charge over the entire recording medium X.

In this manner, in the inkjet recording apparatus 100, the electrostatic sensors 31, 32, 33, and 34 which measure the charge voltages of the recording medium X are provided. Thus, for example, the charge amount to be provided by the upstream-side ion generator 21 to the recording medium X can be adjusted based on the charge voltages measured by the first electrostatic sensors 31, and the charge amount to be provided by the intermediate ion generator 22 to the recording medium X can be adjusted based on the charge voltages measured by the second electrostatic sensors 32. Note that this will be described in detail further below.

Next, an ink spray state in the inkjet recording apparatus 100 is described.

Figure 4:
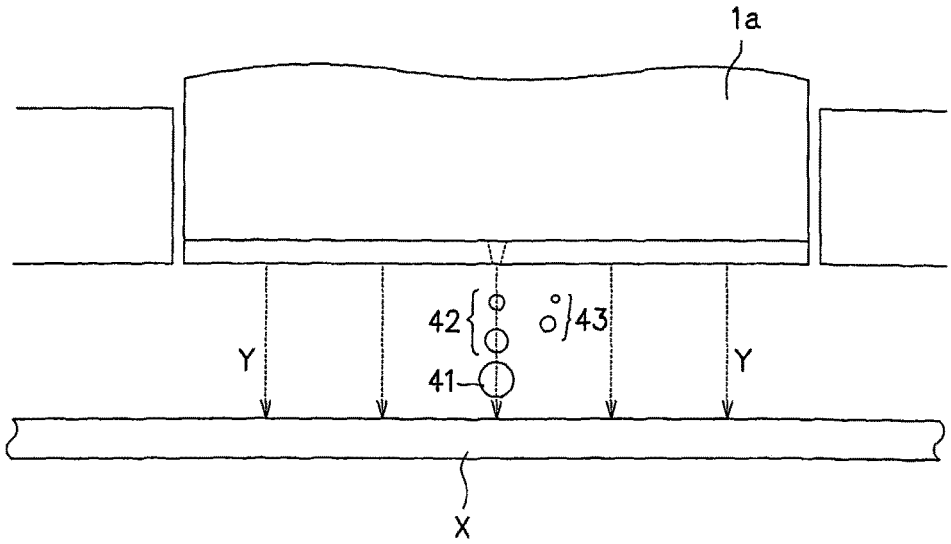
FIG. 4 is a descriptive diagram for describing an ink spray state by the inkjet recording apparatus according to the present embodiment.

FIG. 4 is a descriptive diagram for describing an ink spray state by the inkjet recording apparatus according to the present embodiment. Note that while description is made by using the recording head 1*a* of the first recording unit 1 in FIG. 4, the state becomes similar also in the recording head 2*a* of the second recording unit 2, the recording head 3*a* of the third recording unit 3, and the recording head 4*a* of the fourth recording unit 4.

As depicted in FIG. 4, in the inkjet recording apparatus 100, as described above, the recording head 1*a* is grounded via at least the conductive frame unit 11, and the recording head 1*a* and ink to be sprayed from the recording head 1*a* have a charge voltage of 0 V.

On the other hand, the recording medium X is negatively charged by the upstream-side ion generator 21, as described above.

Therefore, in the inkjet recording apparatus 100, there is a potential difference between the recording head 1*a* and the recording medium X, thereby causing an electrostatic force. That is, an electric field is generated in a direction from the recording head 1*a* with a high potential to the recording medium X with a low potential (a direction indicated by an arrow Y).

In the inkjet recording apparatus 100, when ink is sprayed from the recording head 1*a*, a main ink drop 41 and satellites 42 subsequent thereto are discharged. Note that this discharge is normally performed continuously at high speeds.

Then, when the main ink drop 41 impacts on the recording medium X, splattered small drops 43 also occur.

In the inkjet recording apparatus 100, since the above-described electric field is generated, not only the main ink drop 41 but also the satellites 42 flying subsequently to the main ink drop 41 and the small drops 43 splattered when the main ink drop 41 impacts on the recording medium X are attracted to the recording medium X. Thus, according to the inkjet recording apparatus 100, ink splashes can be prevented.

Also, the influence of the electric field do not cause a disorder of flying trajectories of the main ink drop 41 and the satellites 42, thereby also allowing recording with a high accuracy.

Furthermore, an electric field is similarly generated also on both sides of the recording head 1*a* toward the recording medium X, and a floating ink mist and so forth are thus attracted to the recording medium X and attached to the recording medium X. This can prevent contamination of the recording head 1*a*. Note that the ink mist is generally too subtle to be visually observed even if attached to the recording medium X.

Next, a recording method according to the present invention is described.

Figure 5:
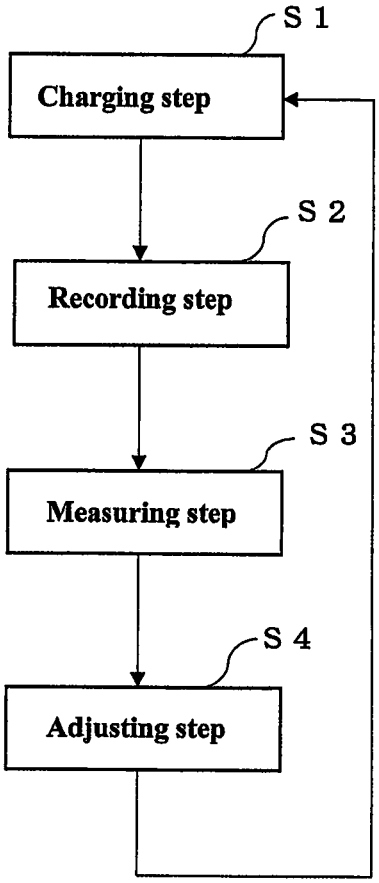
FIG. 5 is a flowchart of a recording method using the inkjet recording apparatus according to the present embodiment.

FIG. 5 is a flowchart of a recording method using the inkjet recording apparatus according to the present embodiment.

As depicted in FIG. 5, the recording method using the inkjet recording apparatus 100 includes: a charging step S1 of providing, by the upstream-side ion generator 21, the recording medium X with a negative charge; a recording step S2 of providing, by each of the recording units 1, 2, 3, and 4, ink to the recording medium X provided with a negative charge; a measuring step S3 of measuring, by the electrostatic sensors 31, 32, 33, and 34, charge voltages of the recording medium X; and an adjusting step S4 of adjusting a charge amount to be provided by the upstream-side ion generator 21 based on the charge voltages.

In the above-described recording method, firstly, the recording medium X is brought from a paper-feeding unit, and the recording medium X is set by being guided by the guide rolls R to a predetermined transfer route. Note that the recording medium X before recording is not necessarily negatively charged.

Then, when the recording medium X is transferred and a portion where recording of the recording medium X starts (hereinafter referred to as a "recording start portion") reaches a plane facing the upstream-side ion generator 21, a negative charge is provided by the upstream-side ion generator 21 (charging step S1). This causes at least the recording start portion to be negatively charged.

Note that the setting of the charge amount to be provided by the upstream-side ion generator 21 will be described further below.

Next, the negatively-charged recording start portion is guided via the immediately-preceding guide roll R1 to a lower side of the recording units 1, 2, 3, and 4.

Then, ink is sprayed onto the negatively-charged recording start portion at the first recording unit 1 (recording step S2).

Also simultaneously, by the first electrostatic sensor 31 on the back surface side of the recording medium X, for example, a charge voltage of the recording start portion immediately before spraying by the first recording unit 1 is measured (measuring step S3). Note that the charge amount to be provided next by the upstream-side ion generator 21 is adjusted based on the charge voltage (adjusting step S4).

Next, when the recording start portion reaches a plane facing the intermediate ion generator 22, a negative charge is provided by the intermediate ion generator 22 as required. This causes the recording start portion to be reliably negatively charged.

Note that the setting of the charge amount to be provided by the intermediate ion generator 22 will be described further below.

Next, ink is sprayed onto the negatively-charged recording start portion at the second recording unit 2 (recording step S2) and, simultaneously, by the second electrostatic sensor 32 on the back surface side of the recording medium X, for example, a charge voltage of the recording start portion immediately before spraying by the second recording unit 2 is measured (measuring step S3).

Also, ink is sprayed onto the negatively-charged recording start portion at the third recording unit 3 (recording step S2) and, simultaneously, by the third electrostatic sensor 33 on the back surface side of the recording medium X, for example, a charge voltage of the recording start portion immediately before spraying by the third recording unit 3 is measured (measuring step S3).

Also, ink is sprayed onto the negatively-charged recording start portion at the fourth recording unit 4 (recording step S2) and, simultaneously, by the fourth electrostatic sensor 34 on the back surface side of the recording medium X, for example, a charge voltage of the recording start portion immediately before spraying by the fourth recording unit 4 is measured (measuring step S3).

Then, based on the charge voltages measured by the second electrostatic sensor 32, the third electrostatic sensor 33, and the fourth electrostatic sensor 34, the charge amount to be provided by the intermediate ion generator 22 is adjusted (adjusting step S4).

Here, the charge amounts to be provided by the upstream-side ion generator 21 and the intermediate ion generator 22 are described.

Figure 6:
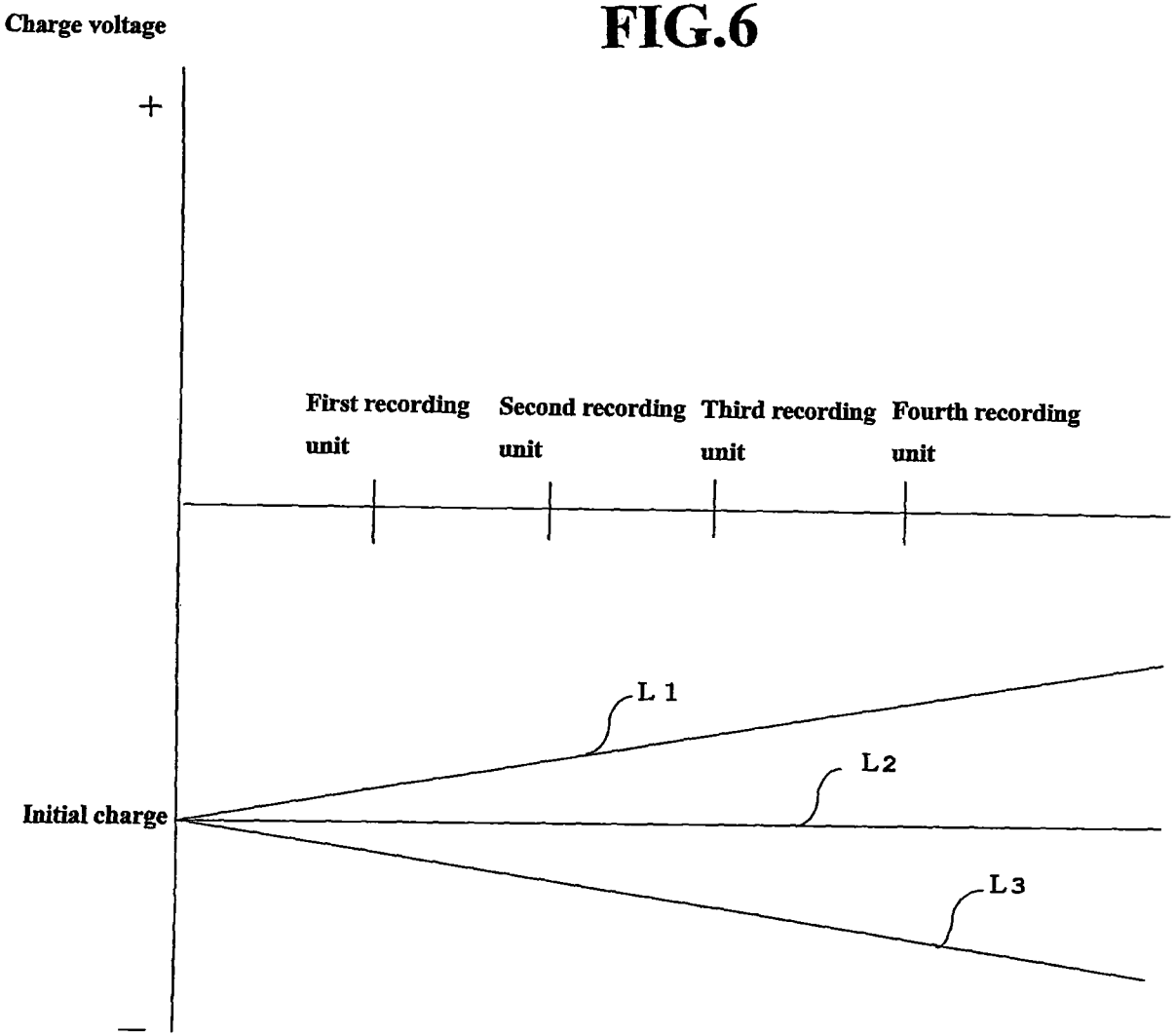
FIG. 6 is a graph depicting changes in charge voltage when a recording is performed while a recording medium with a certain charge voltage is transferred.

FIG. 6 is a graph depicting the changes in the charge voltage when recording is performed while a recording medium with a certain charge voltage is transferred.

As depicted in FIG. 6, firstly, the recording medium X is appropriately negatively charged. Note that the charge voltage at this time is set as an initial charge voltage.

Then, when recording is performed on the recording medium X by the first recording unit 1, the second recording unit 2, the third recording unit 3, and the fourth recording unit 4, a charge voltage L1 tends to gradually increase if the recording medium X is woodfree paper, a change of a charge voltage L2 tends to be small if the recording medium X is inkjet printing paper, and a charge voltage L3 tends to gradually decrease if the recording medium X is coated paper.

From this, the upstream-side ion generator 21 and the intermediate ion generator 22 provide the recording medium X with charges so as to maintain the initial charge voltage.

For example, when the charge voltage L1 increases, a negative charge is provided so that the charge does not become positive. Also, when the charge voltage L2 does not change, no charge is provided. Also, when the charge voltage L1 decreases, no charge is provided or a positive charge is provided.

Next, a method of controlling the upstream-side ion generator 21 is described.

Figure 7:
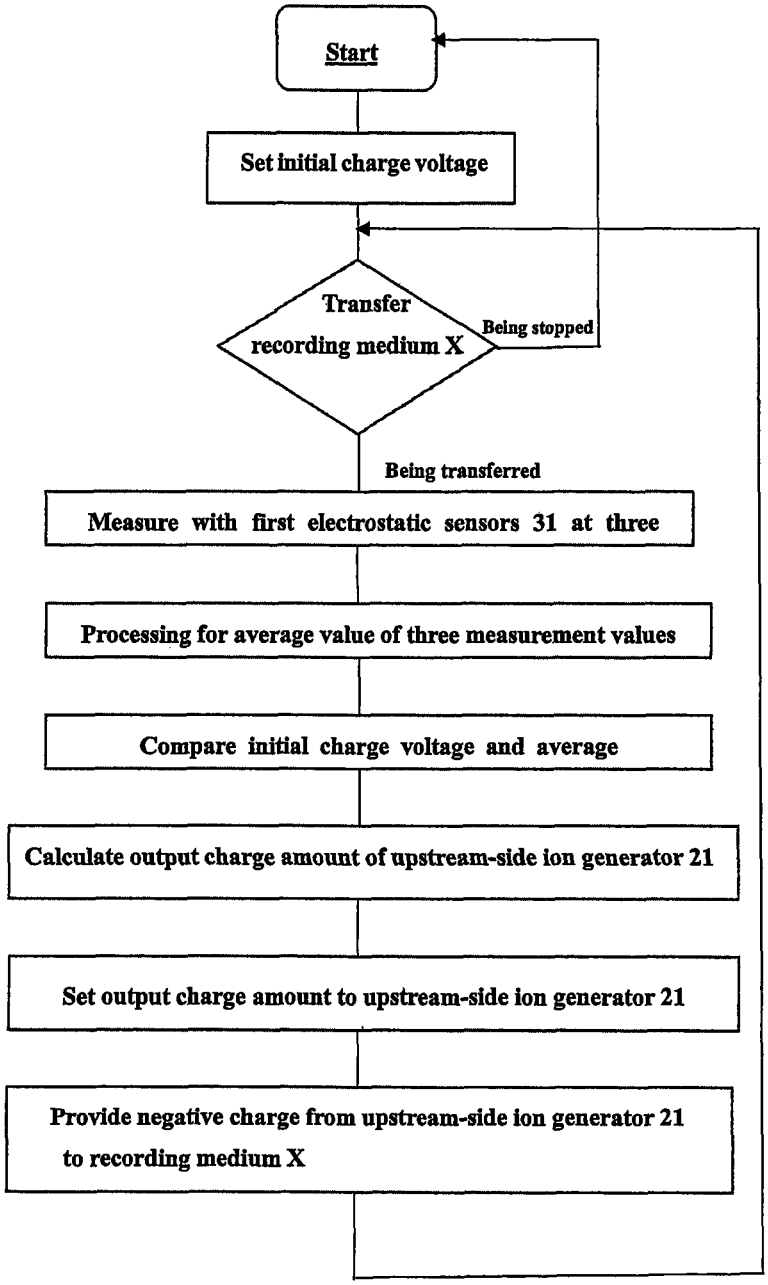
FIG. 7 is a flowchart of a method of controlling an upstream-side ion generator in the recording method using the inkjet recording apparatus according to the present embodiment.

FIG. 7 is a flowchart of the method of controlling the upstream-side ion generator in the recording method using the inkjet recording apparatus according to the present embodiment.

As depicted in FIG. 7, in the method of controlling the upstream-side ion generator 21, firstly, the above-described initial charge voltage is set in the control means, and then transfer of the recording medium X is started.

Note that this control means is a general one having a CPU, an input/output interface, a RAM and a ROM as recording means, a communication means for an external computer or the like, an internal recording unit such as a hard disk, and a driver for using a predetermined external recording medium.

Based on a charge providing instruction from the control means, the upstream-side ion generator 21 provides the recording medium X with a charge so as to maintain the above-described initial charge voltage.

Next, the first electrostatic sensors 31 at three locations measure the charge voltages of the recording medium X at intervals of 100 msec, and transmit the measurement information formed of the three measurement values to the control means.

Next, the control means calculates an average value of the three measurement values from the received measurement information.

Next, the control means compares the average value and the initial charge voltage and calculates a charge amount to be outputted from the upstream-side ion generator 21 so that the recording medium X has a charge amount of an appropriate negative charge.

Next, the upstream-side ion generator 21 provides the recording medium X with a charge based on an instruction for providing a charge with the calculated charge amount from the control means.

This control is repeatedly performed.

Note that when some error occurs during the transfer of the recording medium X and the transfer of the recording medium X is stopped, the process restarts from setting an initial charge voltage to the control means.

Next, a method of controlling the intermediate ion generator 22 is described.

Figure 8:
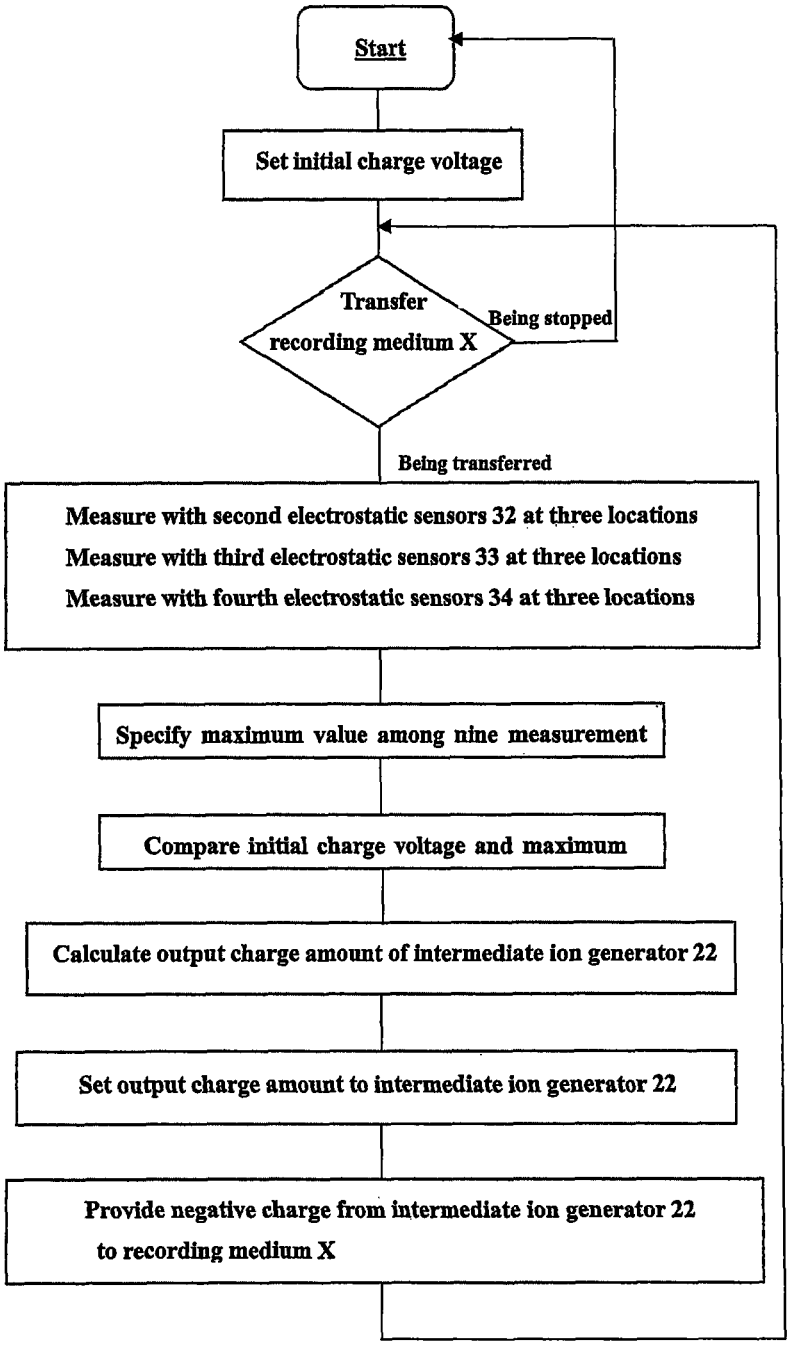
FIG. 8 is a flowchart of a method of controlling an intermediate ion generator in the recording method using the inkjet recording apparatus according to the present embodiment.

FIG. 8 is a flowchart of a method of controlling the intermediate ion generator in the recording method using the inkjet recording apparatus according to the present embodiment.

As depicted in FIG. 8, in the method of controlling the intermediate ion generator 22, as with the case of the upstream-side ion generator 21 described above, the initial charge voltage described above is set in the control means. Note that the value of the initial charge voltage in the intermediate ion generator 22 is set at, for example, the same value as the value of the initial charge voltage in the upstream-side ion generator 21.

The intermediate ion generator 22 provides the recording medium X with a charge so as to maintain the above-described initial charge voltage based on a charge providing instruction from the control means.

Next, the second electrostatic sensors 32 at three locations, the third electrostatic sensors 33 at three locations, and the fourth electrostatic sensors 34 at three locations each measure a charge voltage of the recording medium X at intervals of 100 msec, and transmit the measurement information formed of the nine measurement values in total to the control means.

Next, the control means specifies a maximum value among the nine measurement values from the received measurement information.

Next, the control means compares the maximum value and the initial charge voltage, and calculates a charge amount to be outputted by the intermediate ion generator 22 so that the recording medium X has a charge amount of an appropriate negative charge.

Next, the intermediate ion generator 22 provides the recording medium X with a charge based on an instruction for providing a charge with the calculated charge amount from the control means.

This control is repeatedly performed.

Note that when some error occurs during the transfer of the recording medium X and the transfer of the recording medium X is stopped, the process restarts from setting an initial charge voltage to the control means.

In this manner, in the above-described recording method, in the state in which the recording medium X is appropriately negatively charged, ink is sprayed by the recording units 1, 2, 3, and 4.

Here, the recording method includes the charging step S1 and the recording step S2. Thus, ink is attracted to the recording medium X, allowing the prevention of ink splashes and contamination of the recording heads and also recording with high accuracy.

Also, the method further includes the measuring step S3 and the adjusting step S4. Among those, by performing control on the upstream-side ion generator 21 and the intermediate ion generator 22 as described above, stable recording can be continued, with changes in the charge of the recording medium being supported.

While the embodiment of the present invention has been described, the present invention is not limited to the above-described embodiment.

In the inkjet recording apparatus 100 according to the present embodiment, a negative charge is provided by the upstream-side ion generator 21 to the recording medium X. However, the method with the recording medium taken as being negatively charged is not limited to this. For example, a negative charge may be provided to the recording medium by actively producing friction with another body or by bring another body closer.

While the inkjet recording apparatus 100 according to the present embodiment has the recording units 1, 2, 3, and 4 formed of a plurality of recording heads to spray ink onto the recording medium X, the number of recording units is not particularly limited.

Also, the number of recording heads included in the recording unit is not limited.

In the inkjet recording apparatus 100 according to the present embodiment, each recording head 1*a* is formed of a conductive material in its entirety. However, it is enough that at least the ink circulation channel and the nozzle unit to which the ink is to be sprayed are made of a conductive material and these are grounded via the conductive frame unit 11.

Similarly, while the conductive frame unit 11 is formed of a conductive material in its entirety, a circuit linking the recording heads and the main conductive wire may be formed.

In the inkjet recording apparatus 100 according to the present embodiment, the recording heads are set in a state of being grounded, with the recording heads continued to the grounded substrate 12 via the conductive frame unit 11 and the main conductive wire C1. However, the conductive frame unit 11 may be directly grounded. That is, with the conductive frame unit 11 directly grounded, the state may be such that the recording head continued thereto is grounded.

In the inkjet recording apparatus 100 according to the present embodiment, the upstream-side ion generator 21 is arranged on the upstream side of the immediately-preceding guide roll R1, but may be arranged on the downstream side. That is, the upstream-side ion generator 21 may be arranged between the immediately-preceding guide roll and the recording unit 1.

In the inkjet recording apparatus 100 according to the present embodiment, while the upstream-side ion generator 21 and the intermediate ion generator 22 provide negative charges, if it is assumed that negative charges are accumulated too much in the recording medium X, a positive charge can also be provided.

In the inkjet recording apparatus 100 according to the present embodiment, while the electrostatic sensors 31, 32, 33, and 34 are arranged between the recording head 1*a* on the first row and the recording head 1*a* on the second row at a position opposing the first recording unit 1 on the back surface side of the recording medium X, they are not limited to this position.

The sensors may be provided in front of the first row of the recording head, that is, on an upstream side of the recording unit, to measure a charge amount of the recording medium X before recording by the recording unit. The sensors may be provided at the rear of the fourth row of the recording head, that is, on a downstream side of the recording unit, to measure a charge amount of the recording medium X after recording by the recording medium.

The inkjet recording apparatus 100 in the present embodiment includes the intermediate ion generator 22, but this is not necessarily indispensable.

The position where the intermediate ion generator 22 is provided is not limited to the back surface side of the recording medium X among the recording units 1, 2, 3, and 4.

Similarly, the inkjet recording apparatus 100 includes the second electrostatic sensor 32, the third electrostatic sensor 33, and the fourth electrostatic sensor 34, but they are not necessarily indispensable. Also, the number of electrostatic sensors to be arranged is not particularly limited.

Figure 9:
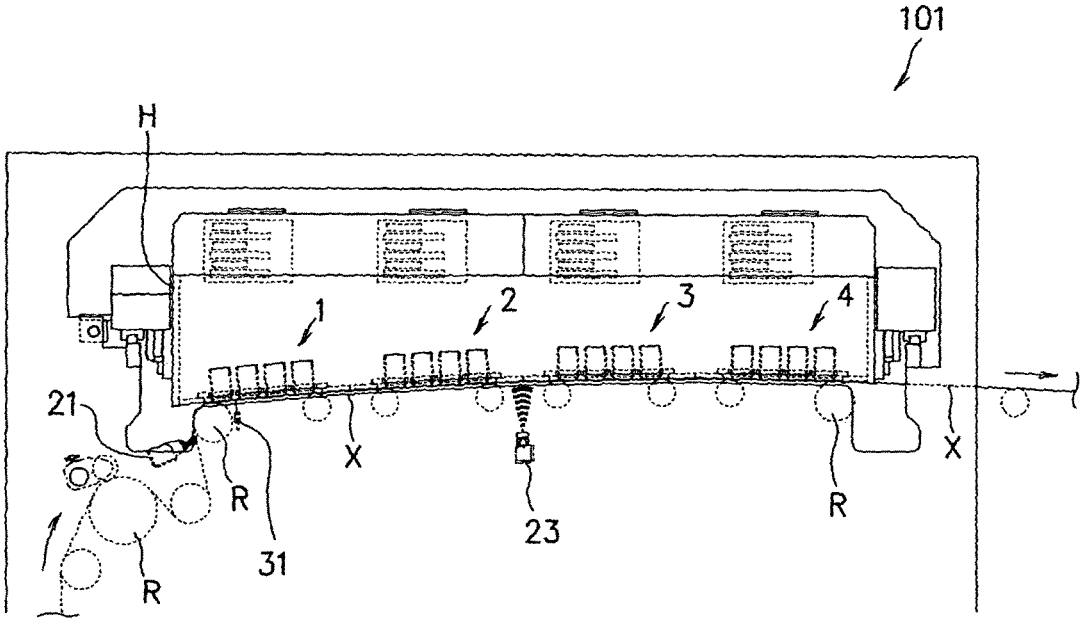
FIG. 9 is a schematic side view depicting an inkjet recording apparatus according to another embodiment.
Figure 10:
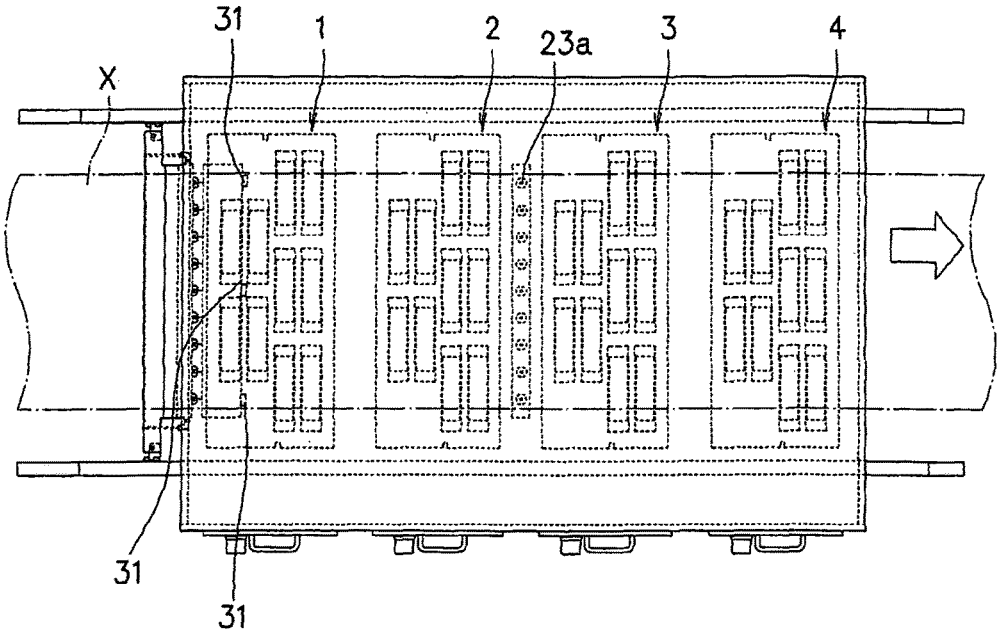
FIG. 10 is a descriptive diagram for describing the positions of the electrostatic sensors with respect to the recording units of the inkjet recording apparatus according to the other embodiment, the diagram viewed from below the recording unit.

FIG. 9 is a schematic side view depicting an inkjet recording apparatus according to the other embodiment, and FIG. 10 is a descriptive diagram for describing the positions of electrostatic sensors with respect to recording units of the inkjet recording apparatus according to the other embodiment, the diagram being viewed from below the recording unit.

As depicted in FIG. 9 and FIG. 10, an inkjet recording apparatus 101 according to the other embodiment includes: a plurality of guide rolls R for guiding the recording medium X; a recording medium X negatively charged; the recording units 1, 2, 3, 4 formed of a plurality of recording heads for spraying ink onto the recording medium X; the housing H which accommodates the recording units 1, 2, 3, and 4; the conductive frame unit 11, not depicted, for supporting the recording heads; the substrate, not depicted, coupled to the recording heads via connectors for controlling the driving of the recording heads; the upstream-side ion generator 21 for providing the recording medium X with a negative charge; an intermediate ion generator 23 on a back surface side of the recording medium X among the recording units 1, 2, 3, and 4 for providing the recording medium X with a negative charge; and the first electrostatic sensors 31 on the back surface side of the recording medium X for measuring a charge voltage of the recording medium X.

That is, in the inkjet recording apparatus 101 according to the other embodiment, the arrangement position of the intermediate ion generator 23 is different, and the second electrostatic sensor, the third electrostatic sensor, and the fourth electrostatic sensor are not provided. Other than that, the apparatus is similar to the inkjet recording apparatus 100 according to the present embodiment.

In the inkjet recording apparatus 101, the intermediate ion generator 23 is provided on the back surface side of the recording medium X between the second recording unit 2 and the third recording unit 3. That is, it is provided midway among the first recording unit 1 to the fourth recording unit 4.

In this case, even if a change occurs in the charge of the recording medium X being transferred due to the spraying of ink by the recording head 1*a* of the first recording unit 1 onto the recording medium X, the spraying of ink by the recording head 2*a* of the second recording unit 2 onto the recording medium X, and rubbing of the recording medium X against the guide rolls R or part of the apparatus, the recording medium X can be appropriately negatively charged again by the intermediate ion generator 23 providing a negative charge.

Also, the recording medium X after the intermediate ion generator 23 providing a negative charge is influenced only by the spraying of ink by the recording head 3*a* of the third recording unit 3 onto the recording medium X and the spraying of ink by the recording head 4*a* of the fourth recording unit 4 onto the recording medium X. Thus, it is effective when the second electrostatic sensor, the third electrostatic sensor, and the fourth electrostatic sensor are not used.

Note in the inkjet recording apparatus 101 that the second electrostatic sensor 32, the third electrostatic sensor 33, and the fourth electrostatic sensor 34 are not provided, the control of the intermediate ion generator 23 as described above is thus not performed, and control is performed only by a sensor for monitoring a charge amount outputted from an ion generating unit 23*a*.

In the control of the upstream-side ion generator 21 in the recording method according to the present embodiment, the control means calculates an average value of three measurement values from the received measurement information and, based on that value, calculates a charge amount to be outputted by the upstream-side ion generator 21. However, a maximum value may be specified among the three measurement values and, based on that value, a charge amount to be outputted by the upstream-side ion generator 21 may be calculated.

Similarly, in the control of the intermediate ion generator 22, the control means specifies a maximum value among the nine measurement values from the received measurement information and, based on that value, calculates a charge amount to be outputted by the intermediate ion generator 22. However, an average value of the nine measurement values may be calculated and, based on that value, a charge amount to be outputted by the intermediate ion generator 22 may be calculated.

INDUSTRIAL APPLICABILITY

The present invention is used as an inkjet recording apparatus which sprays ink onto a transferred recording medium for recording.

According to the inkjet recording apparatus of the present invention, ink splashes and contamination of the recording heads can be prevented, and recording with a high accuracy can be performed.

REFERENCE SIGNS LIST

1 . . . first recording unit (recording unit)
100, 101 . . . inkjet recording apparatus
11 . . . conductive frame unit
12 . . . substrate
1*a*, 2*a*, 3*a*, 4*a* . . . recording head
1*b* . . . connector
2 . . . second recording unit (recording unit)
21 . . . upstream-side ion generator (ion generator)
22, 23 . . . intermediate ion generator (ion generator)
22*a*, 23*a* . . . ion generating unit
3 . . . third recording unit (recording unit)
31 . . . first electrostatic sensor (electrostatic sensor)
32 . . . second electrostatic sensor (electrostatic sensor)
33 . . . third electrostatic sensor (electrostatic sensor)
34 . . . fourth electrostatic sensor (electrostatic sensor)
4 . . . fourth recording unit (recording unit)
41 . . . main ink drop
42 . . . satellite
43 . . . small drop
Y . . . arrow
C1 . . . main conductive wire
C2 . . . sub conductive wire
H . . . housing
H1 . . . lower plate
L1, L2, L3 . . . charge voltage
R . . . guide roll
R1 . . . immediately-preceding guide roll (guide roll)
S1 . . . charging step
S2 . . . recording step
S3 . . . measuring step
S4 . . . adjusting step
X . . . recording medium

The invention claimed is:

1. An inkjet recording apparatus which records on a transferred recording medium by an inkjet scheme, the apparatus comprising:

a guide roll for guiding a recording medium;

a negatively charged recording medium;

a recording unit formed of a plurality of recording heads for spraying ink onto the recording medium;

a conductive frame unit for supporting the recording heads; and an upstream-side ion generator for providing the recording medium with a charge, wherein the recording heads and the conductive frame unit have a continuity relation, the recording heads are grounded via the conductive frame unit, a plurality of the recording units are provided along the transfer route of the recording medium, the upstream-side ion generator is positioned on an upstream side of the recording unit on a transfer route of the recording medium, and the apparatus further comprises, on a back surface side of the recording medium between the recording units, an intermediate ion generator for providing the recording medium with a negative charge.

2. The inkjet recording apparatus according to claim 1, further comprising a substrate coupled to the recording heads via connectors for controlling driving of the recording heads, wherein the conductive frame unit is coupled to the substrate via a main conductive wire, and the recording heads are grounded via the conductive frame unit, the main conductive wire, and the substrate.

3. The inkjet recording apparatus according to claim 2, wherein the recording heads are directly coupled to the substrate via a sub conductive wire.

4. The inkjet recording apparatus according to claim 1, wherein the upstream-side ion generator is arranged on a recording surface side of the recording medium, and is to provide the recording medium with a negative charge.

5. The inkjet recording apparatus according to claim 1, further comprising, on a back surface side of the recording medium, an electrostatic sensor for measuring a charge voltage of the recording medium.

6. The inkjet recording apparatus according to claim 5, wherein the guide roll is arranged between the upstream-side ion generator and the recording unit in the transfer route of the recording medium, and the electrostatic sensor is arranged on a downstream side of the guide roll.

7. The inkjet recording apparatus according to claim 5, wherein the electrostatic sensors are arranged at positions opposing the recording unit.

8. The inkjet recording apparatus according to claim 5, wherein a plurality of the electrostatic sensors are arranged in a width direction of the recording medium.

9. A recording method using an inkjet recording apparatus which records on a transferred recording medium by an inkjet scheme, the apparatus including a guide roll for guiding a recording medium, a negatively charged recording medium, a recording unit formed of a plurality of recording heads for spraying ink onto the recording medium, a conductive frame unit for supporting the recording heads, and an upstream-side ion generator for providing the recording medium with a charge, the recording heads and the conductive frame unit having a continuity relation, the recording heads being grounded via the conductive frame unit, the upstream-side ion generator being positioned on an upstream side of the recording unit on a transfer route of the recording medium, and the apparatus further comprising, on a back surface side of the recording medium, an electrostatic sensor for measuring a charge voltage of the recording medium, the method comprising:

a charging step of providing, by the upstream-side ion generator, the recording medium with a negative charge;

a recording step of spraying, by the recording unit, ink onto the recording medium provided with the negative charge;

a measuring step of measuring, by the electrostatic sensor, a charge voltage of the recording medium; and an adjusting step of adjusting a charge amount to be provided by the upstream-side ion generator based on the charge voltage, wherein the charging step, the recording step, the measuring step, and the adjusting step are repeatedly performed.

10. An inkjet recording apparatus which records on a transferred recording medium by an inkjet scheme, the apparatus comprising:

a guide roll for guiding the recording medium;

a negatively charged recording medium;

a recording unit formed of a plurality of recording heads for spraying ink onto the recording medium;

a conductive frame unit for supporting the recording heads; and an upstream-side ion generator for providing the recording medium with a charge, wherein the recording heads and the conductive frame unit have a continuity relation, the recording heads are grounded via the conductive frame unit, the upstream-side ion generator is positioned on an upstream side of the recording unit on a transfer route of the recording medium, the apparatus further comprises, on a back surface side of the recording medium, an electrostatic sensor for measuring a charge voltage of the recording medium, the guide roll is arranged between the upstream-side ion generator and the recording unit in the transfer route of the recording medium, and the electrostatic sensor is arranged on a downstream side of the guide roll.

11. The inkjet recording apparatus according to claim 10, further comprising a substrate coupled to the recording heads via connectors for controlling driving of the recording heads, wherein the conductive frame unit is coupled to the substrate via a main conductive wire, and the recording heads are grounded via the conductive frame unit, the main conductive wire, and the substrate.

12. The inkjet recording apparatus according to claim 11, wherein the recording heads are directly coupled to the substrate via a sub conductive wire.

13. The inkjet recording apparatus according to claim 10, wherein the upstream-side ion generator is arranged on a recording surface side of the recording medium, and is to provide the recording medium with a negative charge.

14. The inkjet recording apparatus according to claim 10, wherein the electrostatic sensors are arranged at positions opposing the recording unit.

15. The inkjet recording apparatus according to claim 10, wherein a plurality of the electrostatic sensors are arranged in a width direction of the recording medium.

* * * * *